US008523538B2

(12) United States Patent
Kawamura et al.

(10) Patent No.: US 8,523,538 B2
(45) Date of Patent: Sep. 3, 2013

(54) PIEZOELECTRIC PUMP

(75) Inventors: Kenichiro Kawamura, Nagaokakyo (JP); Masayuki Miyamoto, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 100 days.

(21) Appl. No.: 13/052,137

(22) Filed: Mar. 21, 2011

(65) Prior Publication Data

US 2011/0171050 A1 Jul. 14, 2011

(30) Foreign Application Priority Data

Sep. 29, 2008 (JP) ..... 2008-251408

(51) Int. Cl.
*F04B 17/00* (2006.01)

(52) U.S. Cl.
USPC ..... 417/413.2; 417/413.1

(58) Field of Classification Search
USPC ..... 417/413.1, 413.2
See application file for complete search history.

(56) References Cited

U.S. PATENT DOCUMENTS 5,259,737 A 11/1993 Kamisuki et al.
5,542,821 A * 8/1996 Dugan ..... 417/53
5,759,014 A 6/1998 Van Lintel
5,759,015 A * 6/1998 Van Lintel et al. ..... 417/322
6,033,191 A * 3/2000 Kamper et al. ..... 417/322
7,198,250 B2 * 4/2007 East ..... 251/129.06
7,299,815 B2 * 11/2007 Yamanishi ..... 137/15.18
7,311,503 B2 * 12/2007 Van Lintel et al. ..... 417/413.1
2005/0053504 A1 3/2005 Yamanishi

FOREIGN PATENT DOCUMENTS

CN 1605755 A 4/2005
JP 03-031589 A 2/1991
JP 04-063973 A 2/1992
JP 3948493 B2 7/2007
JP 2008-163902 A 7/2008

OTHER PUBLICATIONS

Official Communication issued in International Patent Application No. PCT/JP2009/066901, mailed on Dec. 22, 2009.

* cited by examiner

*Primary Examiner* — Peter J Bertheaud
(74) *Attorney, Agent, or Firm* — Keating & Bennett, LLP

(57) ABSTRACT

A piezoelectric pump is capable of reliably discharging gas and reliably transporting liquid even when intermittently driven. The piezoelectric pump includes a piezoelectric vibrator, a diaphragm deflected and deformed by the piezoelectric vibrator, a pump chamber including at least one wall surface defined by the diaphragm, an inlet through which liquid, gas, or a mixture of liquid and gas flows into the pump chamber, an outlet through which the fluid is discharged, and a liquid holding member arranged to provide a gap between the liquid holding member and the inner surface of the pump chamber and to maintain the liquid in the gap using capillary effect or surface tension. A flow passage plate includes a flow passage groove provided therein.

6 Claims, 6 Drawing Sheets

PIEZOELECTRIC PUMP

BACKGROUND OF THE INVENTION

1. Field of the Invention

The present invention relates to a piezoelectric pump including a diaphragm that is deflected and deformed by a piezoelectric vibrator.

2. Description of the Related Art

In general, piezoelectric pumps including a diaphragm that is deflected and deformed by a piezoelectric vibrator are compact and have a low profile. In addition, such piezoelectric pumps have low power consumption. Accordingly, such piezoelectric pumps can be used as, for example, fuel transportation pumps of fuel cells. However, such piezoelectric pumps are required to have an increased discharge pressure and higher rates of flow of liquid, such as fuel, to be transported and an ability to discharge the air that enters a pump chamber to the outside.

A piezoelectric pump having an increased ability to discharge air (gas) that has entered a pump chamber to the outside is described in Japanese Unexamined Patent Application Publication No. 03-031589 and in Japanese Unexamined Patent Application Publication No. 2008-163902.

The piezoelectric pump described in Japanese Unexamined Patent Application Publication No. 03-031589 includes a casing having an inner surface in which a very small gap is provided between the casing and a piezoelectric vibrator when the amplitude of the piezoelectric vibrator is maximized during a pump compression time (an air ejection time). That is, the inner surface of the casing is configured so that the shape of the inner surface is substantially the same as the shape of the deflected piezoelectric vibrator when the amplitude of the piezoelectric vibrator is maximized.

The piezoelectric pump of Japanese Unexamined Patent Application Publication No. 2008-163902 is described next with reference to FIG. 1. FIG. 1 is a plan view of a piezoelectric pump P described in Japanese Unexamined Patent Application Publication No. 2008-163902. The piezoelectric pump P includes a pump body, an elastic film, a piezoelectric device 21, and a pressure plate 30. The pump body includes a concave portion 11 which is a portion of an inlet valve chest, a concave portion defining a pump chamber 12, and a concave portion 13 that defines an outlet valve chest. A connection passage (an inlet) 14 extends between the inlet concave portion 11 and the pump chamber 12. In addition, a connection passage (an outlet) 15 extends between the outlet concave portion 13 and the pump chamber 12.

The pressure plate 30 includes an opening hole 31 provided therein at a position corresponding to the piezoelectric device 21. An inlet port 34 includes an inlet check valve 40 that opens and closes the inlet port 34. In addition, an outlet port 35 includes an outlet check valve 41 that opens and closes the outlet port 35.

A base portion 16 is provided in the inner bottom surface of the pump chamber 12 so as to face the middle portion of the piezoelectric device 21. A flow passage portion 17 that communicates with the connection passage 14 and the outlet 15 is provided in the outer periphery of the base portion 16. Since a gap between the middle portion of the piezoelectric device 21 and the base portion 16 becomes narrow if the piezoelectric device 21 is deflected and deformed, liquid present on the base portion 16 is ejected out to the flow passage portion 17 on the periphery side. Thus, the air is trapped by the flow passage portion 17. In addition, as the volume of the pump chamber 12 is changed, the liquid in the flow passage portion 17 is ejected towards the outlet 15 and, therefore, the air is ejected together with the liquid.

In order to produce a low-profile piezoelectric pump, the diaphragm and the pump body are made of a thin elastic sheet. However, when the sheet is thin, it is difficult to process the sheet into a particular shape as described in Japanese Unexamined Patent Application Publication No. 03-031589. Accordingly, if an air bubble enters the pump chamber, the pressure generated by the pump decreases. Thus, the air bubble cannot be ejected out and, therefore, the operation of the pump may be stopped.

In addition, as described in Japanese Unexamined Patent Application Publication No. 2008-163902, in the configuration in which the flow passage portion arranged to trap air is provided on the inner periphery of the pump chamber, if the entire pump chamber is filled with air, the air can be effectively ejected (at a time of dry start). However, the piezoelectric pump is not always used such that the piezoelectric pump starts and continuously transports the liquid. The piezoelectric pump needs to have the ability to reliably eject gas and transport the liquid even when the piezoelectric pump is intermittently operated (e.g., the piezoelectric pump starts transporting the liquid and temporarily stops, and subsequently, the piezoelectric pump resumes its operation). However, if a piezoelectric pump having a structure described in Japanese Unexamined Patent Application Publication No. 2008-163902 operates intermittently, it is difficult for the piezoelectric pump to provide sufficient pressure.

SUMMARY OF THE INVENTION

To overcome the problems described above, preferred embodiments of the present invention provide a piezoelectric pump which reliably ejects gas and transports liquid while maintaining a high pressure and a high rate of flow even when intermittently driven.

A piezoelectric pump according to a preferred embodiment of the present invention preferably includes a piezoelectric vibrator arranged to vibrate when an AC voltage is applied, a diaphragm arranged to be deflected and deformed by the piezoelectric vibrator, a pump chamber including at least one wall surface defined by the diaphragm, an inlet through which fluid including liquid, gas, or a mixture of liquid and gas flows into the pump chamber, an outlet through which the fluid is discharged, check valves arranged to prevent the fluid from flowing back through the inlet and the outlet, and a liquid holding member disposed in the pump chamber, wherein the liquid holding member maintains the liquid in a gap between an inner surface of the pump chamber and the liquid holding member.

Such a configuration enables the liquid to be maintained (trapped) in a gap between an inner surface of the pump chamber and the liquid holding member even when the operation stops after the liquid has entered the pump chamber. This is because the liquid is maintained in the gap between the inner surface of the pump chamber and the liquid holding member due to capillary effect or surface tension. Accordingly, in this state, since almost the entire pump chamber is filled with the liquid, the virtual volume of the pump chamber decreases. Therefore, when the operation is resumed, a pressure applied to gas, such as air, present in the pump chamber (hereinafter referred to as "air pressure") increases.

In addition, generally, as the volume of the pump chamber decreases, the flow passage resistance increases and the rate of flow decreases. However, according to preferred embodiments of the present invention, only an apparent volume is decreased by the liquid trapped by the liquid holding member, and the liquid is the liquid to be transported. Accordingly, the increase in the flow passage resistance is negligible. As a result, the air pressure can be increased without decreasing the rate of flow of the liquid to be transported.

The liquid holding member can preferably be made of a single sheet or a plurality of sheets disposed in the pump chamber in a movable manner.

Such a configuration increases an area to which capillary effect or surface tension of liquid is applied, in the liquid in the pump chamber and, therefore, increases a liquid trapping effect.

The single sheet or one of the plurality of sheets can preferably include a concave portion defining a groove on a surface thereof.

Such a configuration increases an area to which capillary effect or surface tension of liquid is applied in the liquid in the pump chamber and, therefore, increases the liquid trapping effect.

The single sheet or one of the plurality of sheets can preferably include a plurality of notches in a peripheral portion thereof.

Such a configuration increases an area to which capillary effect or surface tension of liquid is applied in the liquid in the pump chamber and, therefore, increases the liquid trapping effect.

At least one of the plurality of sheets can preferably be a foam resin molded article, for example.

Such a configuration increases an area to which capillary effect or surface tension of liquid is applied in the liquid in the pump chamber and, therefore, increases the liquid trapping effect.

At least the pump chamber can preferably include a flow passage groove for the fluid in the inner surface of the pump chamber.

Such a configuration ensures a flow passage including a flow passage groove for the liquid even when the height of the pump chamber is minimized in order to achieve a low-profile pump and reduce the volume of the pump. Thus, the rate of flow can be maintained without being affected by pressure loss due to a flow passage resistance.

The liquid holding member can preferably include an opening at a position facing the flow passage groove.

Such a configuration enables a gap between the upper surface of the liquid holding member and the inner surface of the pump chamber to communicate with a gap between the lower surface of the liquid holding member and the inner surface of the pump chamber. Therefore, a decrease in the rate of flow of the liquid is prevented without interrupting the flow of the liquid to be transported.

According to a preferred embodiment of the present invention, when the operation stops after liquid flows into the pump chamber, the equivalent volume of the pump chamber decreases since almost the entire the pump chamber is filled with the liquid. Thus, the air pressure increases. In addition, in general, as the volume of the pump chamber decreases, the flow passage resistance increases and the rate of flow decreases. However, according to a preferred embodiment of the present invention, only an apparent volume is decreased by liquid being trapped by the liquid holding member, and the liquid is liquid to be transported. Accordingly, the increase in the flow passage resistance is negligible. As a result, the air pressure can be increased without decreasing the rate of flow of the liquid to be transported.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
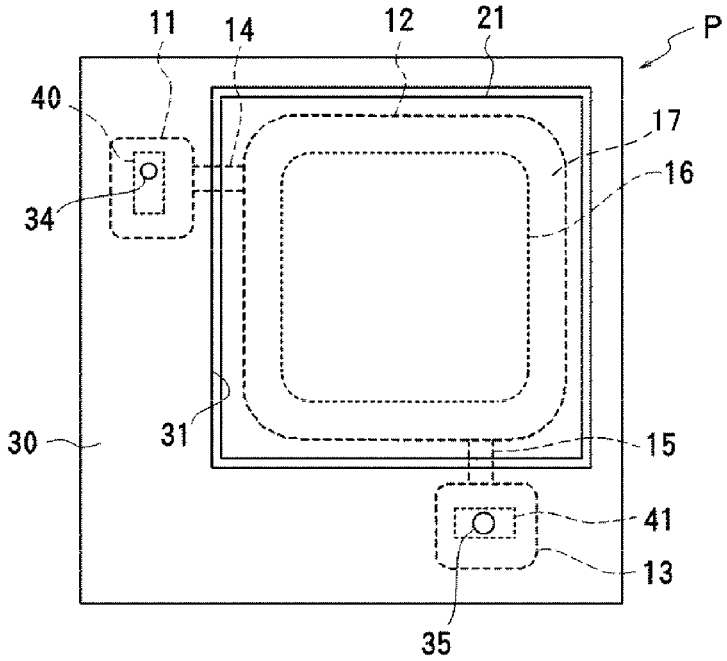
FIG. 1 PRIOR ART
FIG. 1 is a plan view of a piezoelectric pump of the related art.
Figure 2:
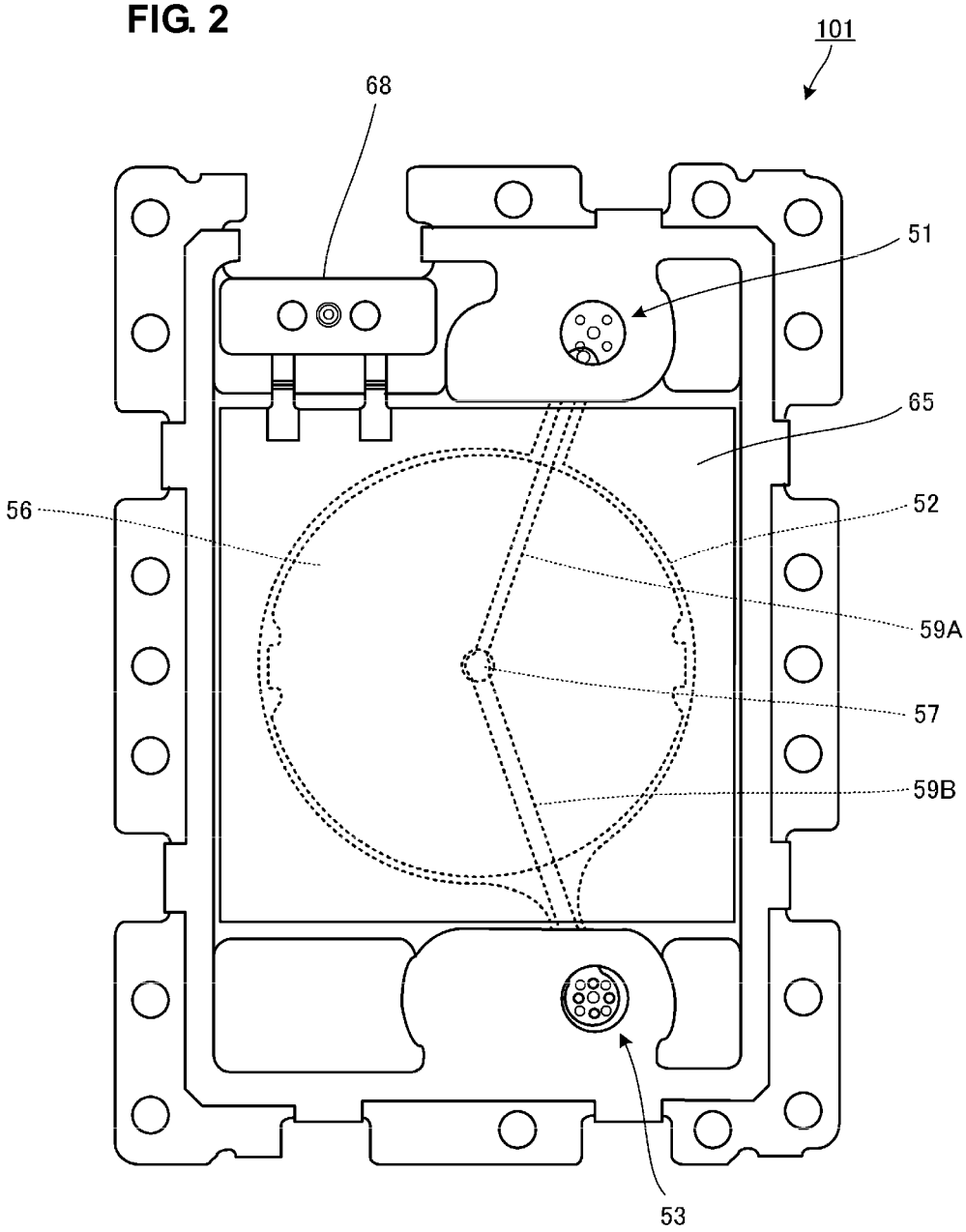
FIG. 2 is a plan view of a piezoelectric pump according to a first preferred embodiment of the present invention.

FIG. 2 is a plan view of a piezoelectric pump 101 according to a first preferred embodiment of the present invention. The piezoelectric pump 101 preferably includes a rectangular or substantially rectangular piezoelectric vibrator 65, a diaphragm that is deflected and deformed by the piezoelectric vibrator 65, a circular or substantially circular pump chamber including the diaphragm defining one side wall thereof, an inlet 51 through which liquid, gas, or a mixture thereof enters the pump chamber, an outlet 53 through which the fluid is discharged, and a liquid holding member 56 that provides a gap between the inner surface of the pump chamber and the liquid holding member 56 and holds the liquid using capillary effect or surface tension.

The inner surface of the pump chamber preferably includes flow passage grooves 59A and 59B in the inner surface thereof for the fluid. The liquid holding member 56 preferably includes an opening 57 in the approximate center thereof. The opening 57 is preferably located at a position facing the center point between the flow passage grooves 59A and 59B.

The piezoelectric vibrator 65 vibrates when an AC voltage is applied to the piezoelectric vibrator 65. Thus, the diaphragm is deflected and deformed. Two electrodes of the piezoelectric vibrator 65 are preferably electrically connected to a connector 68.

Figure 3:
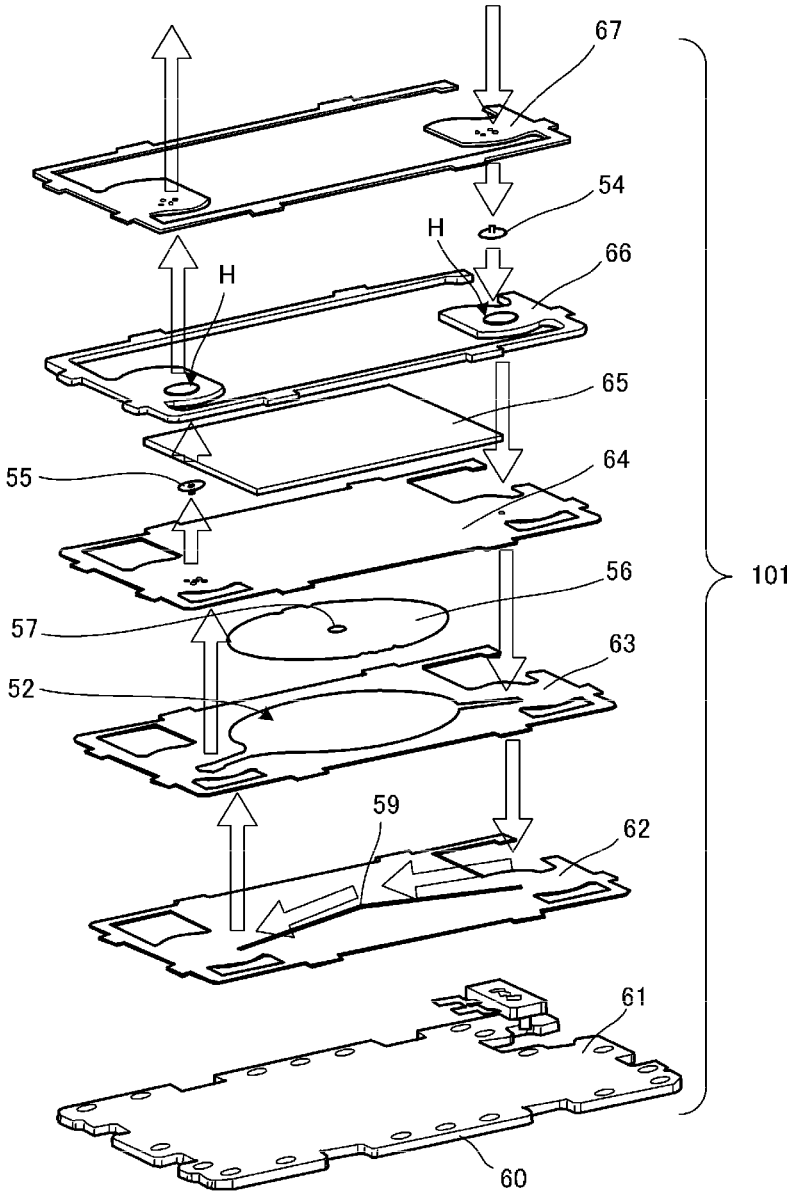
FIG. 3 is an exploded perspective view of the piezoelectric pump according to the first preferred embodiment of the present invention.

FIG. 3 is an exploded perspective view of the piezoelectric pump 101. A top panel 60 of the piezoelectric pump 101 is preferably formed by processing a high stiffness stainless steel. A top panel sheet 61 is preferably provided on the upper surface of the top panel 60 shown in FIG. 3. Note that when the assembled piezoelectric pump 101 is in actual use, the piezoelectric pump 101 is preferably arranged so that the top panel 60 is located at the top. Therefore, although the top panel 60 is located in the lowermost layer in FIG. 3, the term "top panel" is used.

A flow passage plate 62 is preferably disposed on the top panel sheet 61. The flow passage plate 62 preferably includes flow passage grooves 59 (the flow passage grooves 59A and 59B shown in FIG. 2) provided therein.

A pump chamber plate 63 is preferably disposed on top of the flow passage plate 62. The pump chamber plate 63 preferably includes a substantially circular pump chamber 52 formed by cutting out the pump chamber plate 63.

A diaphragm 64 is preferably disposed on top of the pump chamber plate 63. Thus, the pump chamber plate 63 is preferably sandwiched between the diaphragm 64 and the flow passage plate 62. In this manner, a significantly thin cylindrical pump chamber 52 is provided.

The liquid holding member 56 is preferably disposed inside of the pump chamber 52. The liquid holding member 56 preferably includes the opening 57 in the approximate center thereof.

The flow passage plate 62, the pump chamber plate 63, the diaphragm 64, and the liquid holding member 56 are preferably formed by processing PET sheets, for example.

The piezoelectric vibrator 65 preferably made of PZT (lead zirconate titanate), for example, is bonded to the diaphragm 64.

A valve chest plate 66 is preferably disposed on top of the diaphragm 64. A bottom plate 67 is preferably disposed on top of the valve chest plate 66. Note that, as described above, when the assembled piezoelectric pump 101 is in actual use, the piezoelectric pump 101 is arranged so that the bottom plate 67 is located at the bottom. Therefore, although the bottom plate 67 is located in the uppermost layer in FIG. 3, the term "bottom panel" is used.

As noted above, the piezoelectric pump 101 is preferably arranged so that the top panel 60 is located at the top and the bottom plate 67 is located at the bottom.

The valve chest plate 66 is preferably sandwiched between the diaphragm 64 and the bottom plate 67. Thus, two openings provided in the valve chest plate 66 preferably define valve chests H. Check valves 54 and 55 are preferably disposed (enclosed) in the valve chests H and H, respectively.

Figure 4A:
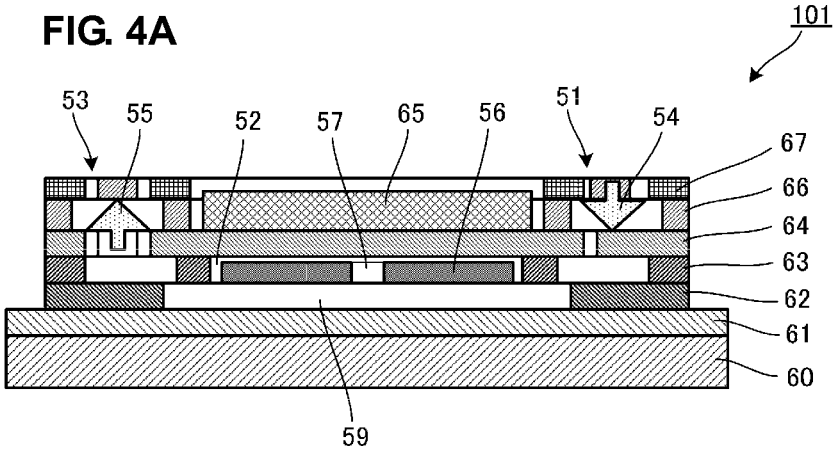
FIGS. 4A and 4B are cross-sectional views of the piezoelectric pump according to the first preferred embodiment of the present invention.
Figure 4B:
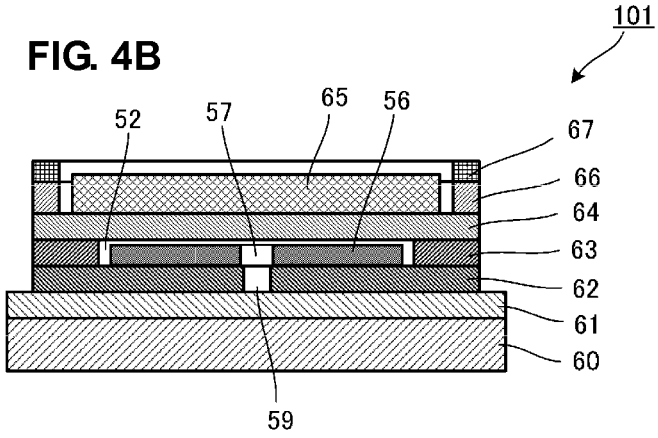

FIGS. 4A and 4B are cross-sectional views of the piezoelectric pump 101. FIG. 4A is a cross-sectional view cut by the vertical plane that passes through the flow passage grooves 59. FIG. 4B is a cross-sectional view cut by the vertical plane that passes through the center of the pump chamber 52 and that is substantially perpendicular to the direction in which the flow passage grooves 59 extend.

Examples of the sizes of the components of the piezoelectric pump 101 and the entire of the piezoelectric pump 101 are as follows:

the pump chamber 52: Diameter about 14.5 mm×Thickness about 0.075 mm the piezoelectric vibrator 65: about 17 mm× about 0.3 mm the liquid holding member 56: Diameter about 14.0 mm×Thickness about 0.06 mm the diaphragm 64: about 19.4 mm× about 28.8 mm×Thickness about 0.075 mm the entire piezoelectric pump 101: about 24 mm× about 33 mm× about 1.325 mm As shown in FIGS. 4A and 4B, the substantially disk-shaped liquid holding member 56 is preferably disposed inside of the pump chamber 52 in a movable manner. The thickness of the liquid holding member 56 is preferably slightly smaller than the thickness of the pump chamber plate 63 that determines the height (the thickness) of the pump chamber. Accordingly, a gap is provided between the upper surface of the liquid holding member 56 and the top plate of the pump chamber 52 (the lower surface of the diaphragm 64). Similarly, a gap is preferably provided between the lower surface of the liquid holding member 56 and the bottom surface of the pump chamber 52 (the upper surface of the flow passage plate 62). In addition, a cylindrical gap is preferably provided between the peripheral edge of the liquid holding member 56 and the inner peripheral surface of an opening provided in the pump chamber plate 63. Accordingly, if liquid enters the pump chamber 52 during transportation of the liquid, the liquid enters the gap. Even after the transportation of the liquid is stopped, the liquid stays in the gap due to capillary effect or surface tension.

The liquid holding member 56 is also referred to as a "narrow space forming member".

The operations of the piezoelectric pump 101 shown in FIGS. 2 to 4B are as follows.

The piezoelectric vibrator 65 preferably deflects the diaphragm 64 in accordance with a voltage applied to the piezoelectric vibrator 65. Thus, the diaphragm 64 is deflected and deformed so that the inner volume of the pump chamber 52 increases or decreases. Accordingly, when an AC voltage is applied to the piezoelectric vibrator 65, the inner volume of the pump chamber 52 alternately increases and decreases.

The check valve 54 preferably prevents the liquid or gas from flowing back through the inlet to the outside. In addition, the check valve 55 prevents the liquid or gas from flowing back through the outlet 53 to the inside. Accordingly, when the pump chamber 52 expands, the liquid enters the pump chamber 52 through the inlet 51. In contrast, when the pump chamber 52 contracts, the liquid is discharged from the pump chamber 52 through the outlet 53.

When the liquid enters the pump chamber 52 for the first time (at a dry start time), the gas is sucked through a route from the inlet 51 to the outlet 53 via the pump chamber 52 (and the flow passage grooves 59). Thereafter, the gas is discharged.

Accordingly, the liquid flows into the pump chamber 52 through the inlet 51. After the pump chamber 52 is filled with the liquid, the liquid is discharged through the outlet 53.

Thereafter, even when the operation of the piezoelectric vibrator 65 is temporarily stopped, the liquid is maintained in the gap in the pump chamber 52 due to capillary effect or surface tension.

Subsequently, immediately after the operation of the piezoelectric vibrator 65 is restarted, the liquid is transported through a route from the inlet 51 to the outlet 53 via the pump chamber 52 (and the flow passage grooves 59).

A relationship between the pressure generated by the pump chamber and the performance of the pump is described next.

The pressure ΔP generated by the pump chamber 52 due to the vibration of the diaphragm 64 is expressed as follows:

$$\Delta P = \text{a rigidity } K \text{ of the pump chamber} \times \text{a variation in the inner volume of the pump chamber } \Delta V.$$

The rigidity K of the pump chamber is expressed as follows:

$$K = 1/\{(1/Ka)+(1/Kp)+(1/Kt)\}$$

where Ka denotes the rigidity of the diaphragm 64, Kp denotes the rigidity of the gas in the pump chamber, and Kt denotes the rigidity of the top panel 60 including the flow passage plate 62 and the top panel sheet 61.

In addition, the inner volume of the pump chamber ΔV is expressed as follows:

$$\Delta V = V\max - V\min$$

where Vmax denotes the inner volume when the pump chamber is expanded, and Vmin denotes the inner volume when the pump chamber is contracted.

Accordingly, the air pressure ΔPa is expressed as follows:

$$\Delta Pa=(1/\{(1/Ka)+(1/Kp)+(1/Kt)\})\times\Delta V.$$

The liquid discharge pressure ΔPl is expressed as follows:

$$\Delta Pl\sim(1/\{(1/Ka)+(1/Kt)\})\times\Delta V.$$

In addition, the rate of flow is expressed as follows:

$$\Delta V\times F(\text{the driving frequency}).$$

Accordingly, by increasing the rigidity K of the pump chamber and increasing the variation in the inner volume of the pump chamber ΔV, the performance of the pump is improved.

In contrast, the rigidity Kp of the gas in the pump chamber is significantly less than the rigidity Ka of the diaphragm and the rigidity Kt of the top panel. That is, the condition: Kp<<Ka, Kt is satisfied. Accordingly, the air pressure ΔPa is rewritten as follows:

$$\Delta Pa\sim Kp\times\Delta V.$$

Let C denote a constant. Then, the rigidity Kp of the gas in the pump chamber can be expressed as follows:

$$Kp=C/V.$$

Thus, the air pressure ΔPa is rewritten as follows:

$$\Delta P\sim C\times\Delta V/V.$$

Therefore, by minimizing the inner volume of the pump chamber, the air pressure is increased.

As described above, since the liquid is maintained in the gap defined by the inner surface of the pump chamber 52 and the outer surface of the liquid holding member 56 due to capillary effect or surface tension, the apparent inner volume of the pump chamber for the gas is decreased. Thus, the air pressure is increased.

Figure 5:
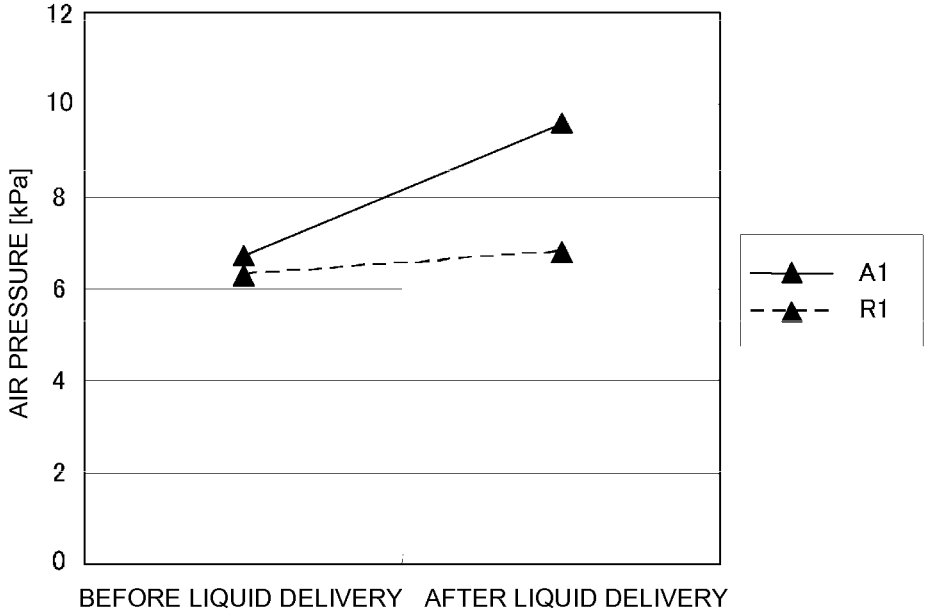
FIG. 5 illustrates the characteristics of the air pressure of the piezoelectric pump shown in FIGS. 2 to 4.

FIG. 5 illustrates the characteristics of the air pressure of the piezoelectric pump 101 shown in FIGS. 2 to 4B. In this preferred embodiment, the characteristics were compared with those of the piezoelectric pump 101 shown in FIGS. 2 to 4B including the liquid holding member 56 fixed to the side of the flow passage plate 62. In FIG. 5, A1 indicates the characteristics of the piezoelectric pump according to the first preferred embodiment of the present invention. R1 indicates the characteristics of a piezoelectric pump according to the comparative example. Measurement was made three times for each of the piezoelectric pumps. The piezoelectric devices were driven using±6 V square waves (the driving frequency: 1 Hz).

It can be seen from FIG. 5 that in the piezoelectric pump according to the comparative example, the air pressure slightly increases after the liquid flows into the pump chamber 52. In contrast, in the piezoelectric pump according to the first preferred embodiment, the air pressure significantly increases by as much as about 3 kPa or more. Thus, if the liquid holding member is not fixed, an increased air pressure is obtained. Note that the rate of flow was about 1.5 μl/s for each of the piezoelectric pumps.

Figure 6:
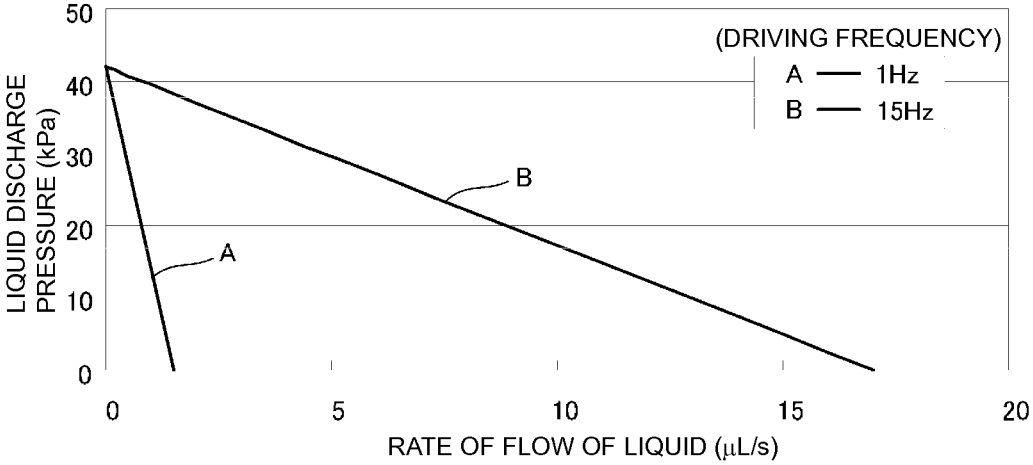
FIG. 6 illustrates a relationship between the driving frequency and the rate of flow of the piezoelectric pump shown in FIGS. 2 to 4B.

FIG. 6 illustrates a relationship between the rate of flow and the discharge pressure (the P-Q characteristic) using the driving frequency of the piezoelectric vibrator 65 of the piezoelectric pump 101 shown in FIGS. 2 to 4B as a parameter. In this example, methanol was used as the liquid to be transported.

When the rate of flow is zero, the discharge pressure of the liquid is about 42 kPa. As indicated by the straight line A, at a driving frequency of about 1 Hz, when the discharge pressure of the liquid is about 0 kPa, the rate of flow is about 1.5 μl/s. As indicated by the straight line B, at a driving frequency of about 15 Hz, when the discharge pressure of the liquid is about 0 kPa, the rate of flow is about 17 μl/s. In this manner, by increasing the driving frequency, a high rate of flow is obtained.

The first preferred embodiment of the present invention provides the following advantages.

After liquid flows into the pump chamber, the liquid is maintained in the gap defined by the inner surface of the pump chamber and the liquid holding member due to capillary effect or surface tension. Therefore, the apparent inner volume of the pump chamber for the gas is less than that in the initial state (the state in which the liquid has not yet entered the pump chamber). Thus, the air pressure is increased. Accordingly, the efficiency of discharging air bubbles is increased. Thus, even when an air bubble enters the pump chamber, the operation of the pump is not stopped. In addition, since the inner volume of the pump is decreased by using the transported liquid itself, a decrease in the rate of flow due to an increase in the flow passage resistance does not occur.

Since a flow passage groove is preferably provided in the inner surface of the pump chamber, the required rate of flow is maintained without being affected by a pressure loss due to the passage flow resistance even when the height of the pump chamber is minimized in order to produce a low-profile pump and to reduce the volume of the pump.

Since the volume of the pump chamber can be reduced while maintaining a minimum gap in which the diaphragm can deflect, the air pressure is increased and, therefore, a high efficiency of discharging air bubbles is obtained.

Since the liquid holding member can be formed from a thin sheet, the processing costs of the member are not high.

Second Preferred Embodiment

Figure 7:
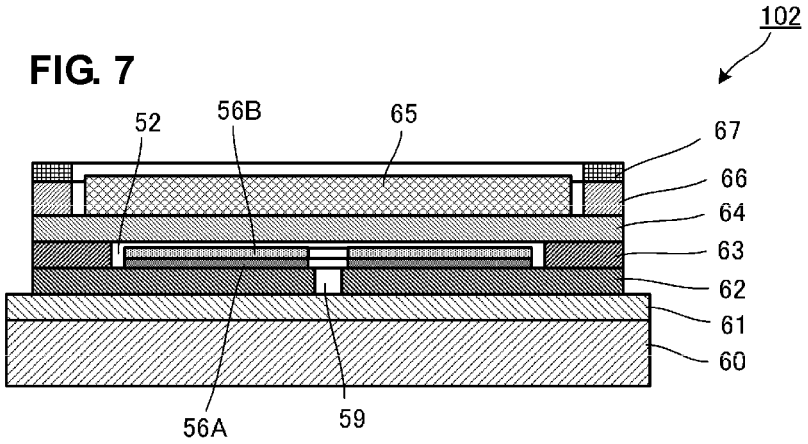
FIG. 7 is a cross-sectional view of a piezoelectric pump 102 according to a second preferred embodiment of the present invention.

FIG. 7 is a cross-sectional view of a piezoelectric pump 102 according to a second preferred embodiment of the present invention. FIG. 7 corresponds to FIG. 4B of the first preferred embodiment. That is, FIG. 7 is a cross-sectional view of the piezoelectric pump 102 cut by a plane that passes through the center of the pump chamber 52 and that is substantially perpendicular to a direction in which the flow passage grooves 59 extend.

Unlike the piezoelectric pump 101 described in the first preferred embodiment, the piezoelectric pump 102 preferably includes two liquid holding members 56A and 56B inside the pump chamber 52. The remaining structure is substantially the same as that of the first preferred embodiment.

The thickness of the stacked liquid holding members 56A and 56B is preferably slightly less than the thickness of the pump chamber plate 63 that determines the height (the thickness) of the pump chamber 52. Accordingly, a gap is preferably provided between the bottom surface of the lower liquid holding member 56A and the flow passage plate 62, a gap is preferably provided between the liquid holding members 56A and 56B, and a gap is preferably provided between the upper liquid holding member 56B and the diaphragm 64. Furthermore, a gap is preferably provided between the peripheral edge of each of the liquid holding members 56A and 56B and the inner peripheral surface of the opening provided in the pump chamber plate 63.

By arranging the two liquid holding members 56A and 56B in this manner, the total area of the gap portions that hold the liquid due to capillary effect or surface tension is increased. Thus, the ability to hold the liquid is further increased.

In the second preferred embodiment as shown in FIG. 7, the two liquid holding members 56A and 56B are preferably provided. However, three or more liquid holding members may be provided.

Third Preferred Embodiment

Figure 8:
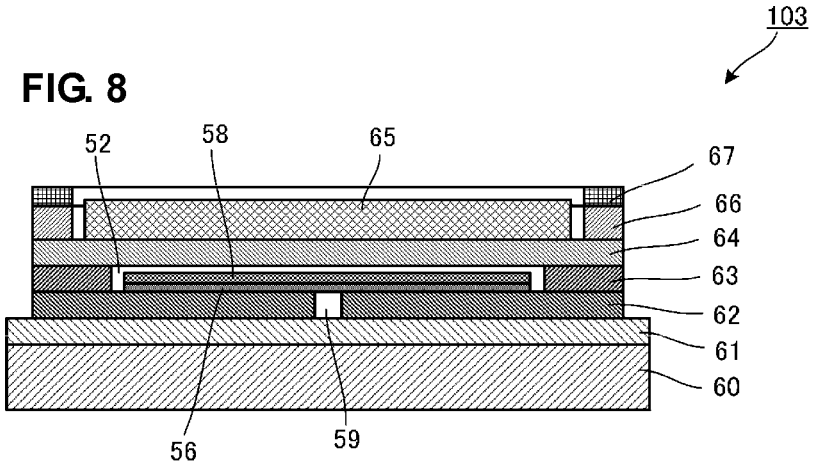
FIG. 8 is a cross-sectional view of a piezoelectric pump 103 according to a third preferred embodiment of the present invention.

FIG. 8 is a cross-sectional view of a piezoelectric pump 103 according to a third preferred embodiment of the present invention. FIG. 8 corresponds to FIG. 4B of the first preferred embodiment. That is, FIG. 8 is a cross-sectional view of the piezoelectric pump 103 cut by a plane that passes through the center of the pump chamber 52 and that is substantially perpendicular to a direction in which the flow passage grooves 59 extend.

Unlike the piezoelectric pump 101 described in the first preferred embodiment, the piezoelectric pump 103 preferably includes the liquid holding member 56 and a liquid holding member 58 inside the pump chamber 52. The remaining structure is substantially the same as that of the first preferred embodiment.

The liquid holding member 56, which is one of two liquid holding members, is preferably made of the same material as that used for the liquid holding member 56 of the first preferred embodiment or that used for the liquid holding members 56A and 56B of the second preferred embodiment (a PET sheet), for example. The liquid holding member 58, which is the other liquid holding member, is preferably made of a foam resin sheet having a disk shape. For example, the liquid holding member 58 is preferably a foam resin article, such as a polyurethane foam article. Since the liquid holding member 58 is preferably porous, the liquid holding member 58 holds the liquid inside a plurality of pores. In addition, since the liquid holding member 58 is preferably flexible, the liquid holding member 58 functions as a shock-absorbing material so that the diaphragm 64 is not brought into direct contact with the liquid holding member 56.

In this manner, even when the liquid holding member is porous, the liquid is maintained due to capillary effect or surface tension. Therefore, the third preferred embodiment provides substantially the same advantages as those of the first and second preferred embodiments.

Fourth Preferred Embodiment

Figure 9:
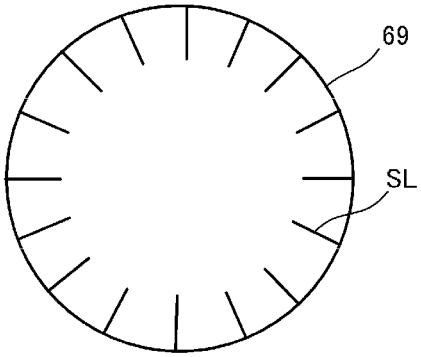
FIG. 9 is a plan view of a liquid holding member used for a piezoelectric pump according to a fourth preferred embodiment of the present invention.

FIG. 9 is a plan view of a liquid holding member of a piezoelectric pump according to a fourth preferred embodiment of the present invention. As shown in FIG. 9, a liquid holding member 69 preferably includes a plurality of notches SL in the outer peripheral portion.

Since liquid is maintained in the notches SL due to capillary effect or surface tension, the liquid holding area in the pump chamber is increased.

While the example shown in FIG. 9 has been described with reference to the liquid holding member 69 including the notches SL in the peripheral portion, concave portions, such as grooves, may be provided on the surface of the liquid holding member instead of the notches. Thus, the liquid is maintained in the concave portions due to capillary effect or surface tension. In this manner, the total liquid holding area in the pump chamber is increased.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A piezoelectric pump comprising:

a piezoelectric vibrator arranged to vibrate when an AC voltage is applied;

a diaphragm arranged to be deflected and deformed by the piezoelectric vibrator;

a pump chamber including at least one wall surface defined by the diaphragm;

an inlet through which a fluid including liquid, gas, or a mixture of liquid and gas flows into the pump chamber;

an outlet through which the fluid is discharged;

check valves arranged to prevent the fluid from flowing back through the inlet and the outlet; and a liquid holding member, which is separate from the check valves, disposed in the pump chamber to maintain any liquid included in the fluid in a gap between an inner surface of the pump chamber and the liquid holding member; wherein the liquid holding member includes a single sheet or a plurality of sheets disposed in the pump chamber in a movable manner.

2. The piezoelectric pump according to claim 1, wherein the single sheet or one of the plurality of sheets includes a concave portion on a surface thereof.

3. The piezoelectric pump according to claim 1, wherein the single sheet or one of the plurality of sheets includes a plurality of notches in a peripheral portion thereof.

4. The piezoelectric pump according to claim 1, wherein at least one of the plurality of sheets is a foam resin molded article.

5. The piezoelectric pump according to claim 1, wherein at least the pump chamber includes a fluid flow passage groove in the inner surface thereof.

6. The piezoelectric pump according to claim 5, wherein the liquid holding member includes an opening at a position facing the fluid flow passage groove.

* * * * *